US006871598B2

(12) United States Patent
Schaller et al.

(10) Patent No.: US 6,871,598 B2
(45) Date of Patent: Mar. 29, 2005

(54) ARRANGEMENT OF RADIAL BOGIE

(75) Inventors: Hans-Dieter Schaller, La Grange, IL (US); Xiaoying Ma, Itasca, IL (US); David Jason Goding, Palos Park, IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/172,806

(22) Filed: Jun. 14, 2002

(65) Prior Publication Data

US 2003/0230213 A1 Dec. 18, 2003

(51) Int. Cl.[7] ..... B61F 5/00

(52) U.S. Cl. ..... 105/168; 105/167; 105/34.1; 105/157.1

(58) Field of Search ..... 105/166, 168, 105/667, 665, 182.1, 183, 167, 165, 157.1, 199.1, 176, 182 R, 188, 206.1, 196, 208

(56) References Cited

U.S. PATENT DOCUMENTS 86,685 A * 2/1869 Perry et al. ..... 105/168
4,067,262 A * 1/1978 Scheffel ..... 105/168
4,485,743 A * 12/1984 Roush et al. ..... 105/176
4,628,824 A 12/1986 Goding et al. ..... 105/168
4,679,506 A 7/1987 Goding et al. ..... 105/136
4,679,507 A * 7/1987 Rassaian ..... 105/136
4,765,250 A * 8/1988 Goding ..... 105/166
4,841,873 A 6/1989 Goding et al. ..... 105/168
5,263,420 A 11/1993 Schwendt et al. ..... 105/166
5,375,533 A 12/1994 Schwendt ..... 105/166
5,438,933 A 8/1995 Lipsius et al. ..... 105/168
5,555,816 A 9/1996 Jones ..... 105/168
5,582,111 A * 12/1996 De Ro et al. ..... 105/167
5,603,265 A 2/1997 Jones ..... 105/167
5,613,444 A 3/1997 Ahmadian et al. ..... 105/166
5,678,490 A 10/1997 Parussatti et al. ..... 105/167
5,730,064 A 3/1998 Bishop ..... 105/168
5,746,135 A 5/1998 Ahmadian et al. ..... 105/196
6,418,859 B1 * 7/2002 Hentschel et al. ..... 105/167

* cited by examiner

*Primary Examiner*—Frantz F. Jules
(74) *Attorney, Agent, or Firm*—Cary W. Brooks

(57) ABSTRACT

An arrangement for self-steering, radial bogie, truck or vehicle frame for locomotives and other railroad vehicles, which includes steering beams for and located behind their respective leading and trailing wheelsets, and whose rotary motions are coupled by an inter-axle link to provide opposite transverse movement of the first and third wheelsets upon traversing curves.

24 Claims, 2 Drawing Sheets

ARRANGEMENT OF RADIAL BOGIE

TECHNICAL FIELD

The present invention relates generally to railroad vehicles and particularly to steerable railroad trucks or bogies.

BACKGROUND OF THE INVENTION

In self-steering bogies, the radial adjustment of their wheelsets for curve negotiation is effected by the longitudinal forces that arise at contact surface points of the wheels as they travel around curves. Such radial adjustability is generally proposed to reduce friction and wear of the wheels and rails by minimizing lateral creep forces. The use of such self-steering bogies has been considered both for unpowered railroad cars and for locomotives with motorized axles. The present inventors have recognized a need for improvements in bogie design.

SUMMARY OF THE INVENTION

The present invention meets the above-mentioned need by providing a railroad truck or bogie, with two or more powered or unpowered wheelsets and specially located steering beams associated with the wheelsets.

An inter-axle link couples the rotation of the steering beam for the leading wheel set with the steering beam of the trailing wheel set. The inter-axles link may be of a one-piece design or a split design with a support level system.

Although the present invention is not limited to specific advantages or functionality, it is noted that the present bogie permits improve accessibility to other undercarriage components between wheelsets and frees up space on the bogie for other attachments. Additionally, by permitting long traction links, the present bogie reduces the angular loading of the traction link bushings, and reduces the contribution of the traction links to the total vertical and lateral stiffness in the primary suspension. Further, according to one aspect of the present invention, by arranging the steering beam of the trailing wheel adjacent a bogie end, shorter wheelbase and shorter overall bogie assembly length than with conventional bogies can be realized (e.g., around 3800 mm compared to approximately 4200 mm) without comprising other areas like accessibility of carbody linkage and traction motor brushes, or shorting the traction links.

In one embodiment, provided is a radial bogie for rail vehicles comprising a frame having longitudinally extending side frames laterally spaced by transoms, the side frames defining a longitudinal axis and having leading and trailing ends. Included are leading and trailing wheelsets with axles supported on the frame, and first and second steering beams for pivotally guiding the wheelsets. The first steering beam is pivotably mounted on the frame behind the leading wheelset away from the leading end of the frame, and the second steering beam is pivotably mounted on the frame behind the trailing wheelset towards the trailing end of the frame. Traction links are connected between the wheelsets and the steering beams.

In another embodiment, provided is a radial bogie for rail vehicles comprising a frame having longitudinally extending side frames laterally spaced by transoms, the side frames having side posts and defining a longitudinal axis. Included are two end wheelsets with axles supported on the frame, the two end wheelsets being pivotably mounted on the frame, and a center wheelset with an axle supported on the frame between the two end wheelsets. The center wheelset is substantially unpivotably connected to the side posts by traction links and is movable laterally to the longitudinal axis. Included also are steering beams for pivotally guiding the end wheelsets, each one of the steering beams is pivotably mounted on the frame behind a respective one of the end wheelsets, additional traction links connected between the end wheelsets and the steering beams, and an inter-axle linkage connected between the steering beams.

In still another embodiment, provided is a radial bogie for rail vehicles comprising a frame having a leading end and defining a longitudinal axis; first, second and third wheelsets having axles being elastically supported on the frame; and a pair of steering beams, one each located behind the first and third wheelsets away from the leading end of the frame. Traction links couple the first and third wheelsets to the steering beams and the second wheelset to the frame. Included also is an inter-axle link coupling rotary motions about vertical axes of the steering beams to provide opposite transverse movement of the first and third wheelsets upon traversing curves.

In still yet another embodiment, provided is a railroad locomotive of the type comprising a carbody supported by at least one self-steering radial bogie having a frame having longitudinally extending side frames laterally spaced by transoms, the side frames defining a longitudinal axis and having leading and trailing ends; leading and trailing driven wheelsets with axles supported on the frame; and first and second steering beams for pivotally guiding the wheelsets. The first steering beam is pivotably mounted on the frame behind the leading wheelset away from the leading end of the frame, and the second steering beam is pivotably mounted on the frame behind the trailing wheelset towards the trailing end of the frame. Traction links are connected between the wheelsets and the steering beams, and an inter-axle linkage is connected between the steering beams.

In still another embodiment, provided is running gear for rail vehicles comprising at least one bogie. The at least one bogie has a frame having longitudinally extending side frames laterally spaced by transoms, the side frames defining a longitudinal axis and having leading and trailing ends; leading and trailing wheelsets with axles supported on the frame; and first and second steering beams for pivotally guiding the wheelsets. The first steering beam is pivotably mounted on the frame behind the leading wheelset away from the leading end of the frame, and the second steering beam is pivotably mounted on the frame behind the trailing wheelset toward the trailing end of the frame. Traction links are connected between the wheelsets and the steering beams, and an inter-axle linkage is connected between the steering beams.

These and other features and advantages of the invention will be more fully understood from the following description of a preferred embodiment of the invention taken together with the accompanying drawings. It is noted that the scope of the claims is defined by the recitations therein and not by the specific discussion of features and advantages set forth in the present description.

BRIEF DESCRIPTION OF THE DRAWINGS

The following detailed description of the embodiments of the present invention can be best understood when read in conjunction with the following drawings, where like structure is indicated with like reference numerals and in which.

Figure 1:
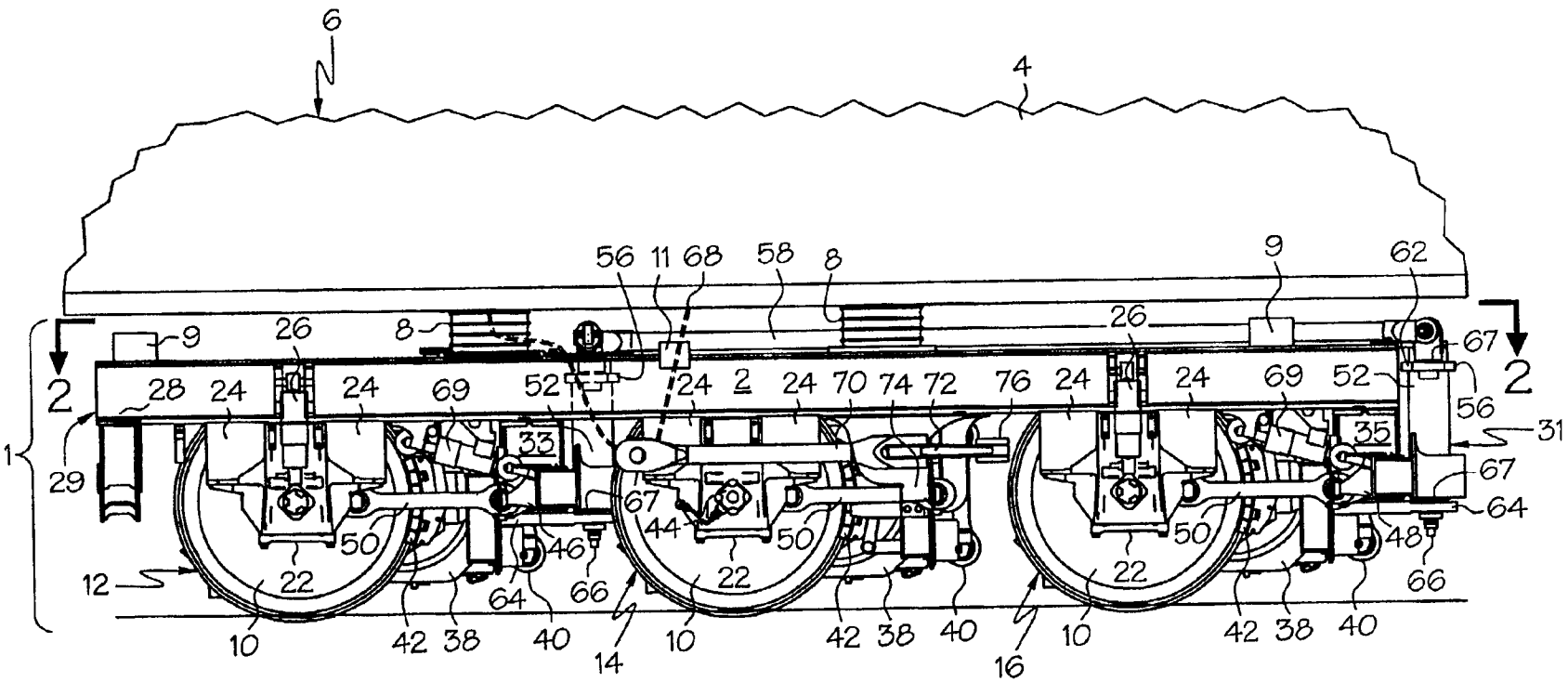
FIG. 1 is a fragmentary, diagrammatic, side-elevational view of a running gear for rail vehicles with radial adjustability having a construction of an inter-axle rod interconnecting steering beams located behind leading and trailing wheelset with some parts being shown in phantom and other parts removed for conveniences of illustration.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DESCRIPTION OF THE PREFERRED EMBODIMENT

The invention may be embodied in rail trucks or bogies having at least two or more axles, and can be used with both locomotives and non-driven railroad vehicles. Referring now to the figures of the drawing in detail and first, particularly, to FIG. 1 thereof, there is seen an embodiment of a running gear or undercarriage, generally indicated as 1, for a railroad vehicle with radial adjustability having a construction of at least two steering beams located behind their respective wheelsets, and an inter-axle linkage or guide rod interconnecting the rotation of the steering beams of the leading and trailing wheelsets. The terms leading and trailing are used for descriptive purposes only as the running gear may be operated equally well in either direction of operation.

The running gear 1 includes at least one truck frame or bogie 2, which elastically supports a carbody 4 of a railroad vehicle, generally indicated by numeral 6. In one embodiment, the railroad vehicle 6 is a self-powered railroad locomotive having the carbody 4 supported by at least two motorized self-steering railroad bogies 2 (only one of which is shown) having two or more wheelsets. In another embodiment, the railroad vehicle 6 may be an unpowered railroad car having the carbody 4 supported by at least two or more self-steering railroad bogies 2 having two or more wheelsets.

Spring elements 8 are provided along the top of the bogie to provide suspension and support for the carbody 4. The spring elements 8, which could be replaced by any other suitable resilient suspension means, are made stiff in compression to provide a relatively hard secondary suspension between the truck frame and carbody. The spring elements 8 yield more freely in sheer to permit limited lateral motion as well as yawing motion of the bogie relative to the carbody 4 during normal curve negotiation. Carbody stops 9, provided also along the top of the bogie 2, are arranged to engage inner portions of the carbody 4 to limit the amount of yaw carbody motion as required. Additionally, lateral stops 11 are provided on the bogie 2 to limit the amount of lateral carbody motion as required.

In the illustrated embodiment, elastically suspended from the bogie 2 are a first wheelset 12, a second wheelset 14, and a third wheelset 16. Each wheelset 12, 14, and 16 comprises a first rail engageable wheel 10 and a second rail engageable wheel 18. Left and right wheels 10 and 18 of each wheelset 12, 14, and 16 are support by an axle 20 and are generally parallel and laterally spaced from each other. Additionally, the wheelsets 12, 14, and 16 are also laterally spaced to form longitudinally spaced wheel and axle assemblies. A bearing housing 22 rotatably supports each end of the axle 20 and elastically supports the bogie 2 through wheelset spring elements 24.

The bearing housing 22 may be either a one-piece or a two-piece design. In the one-piece design, the bearing housing 22 is a single piece that encloses the bearing assembly totally (note shown). In the two-piece design, the bearing housing 22 includes upper and lower housing parts. The upper housing provides the interface to the bearing assembly and transfers vertical and horizontal loads. The lower part, or bearing cap/retainer, provides the means of lifting the wheelset with the bearing house and adds structural strength to the whole assembly.

Figure 2:
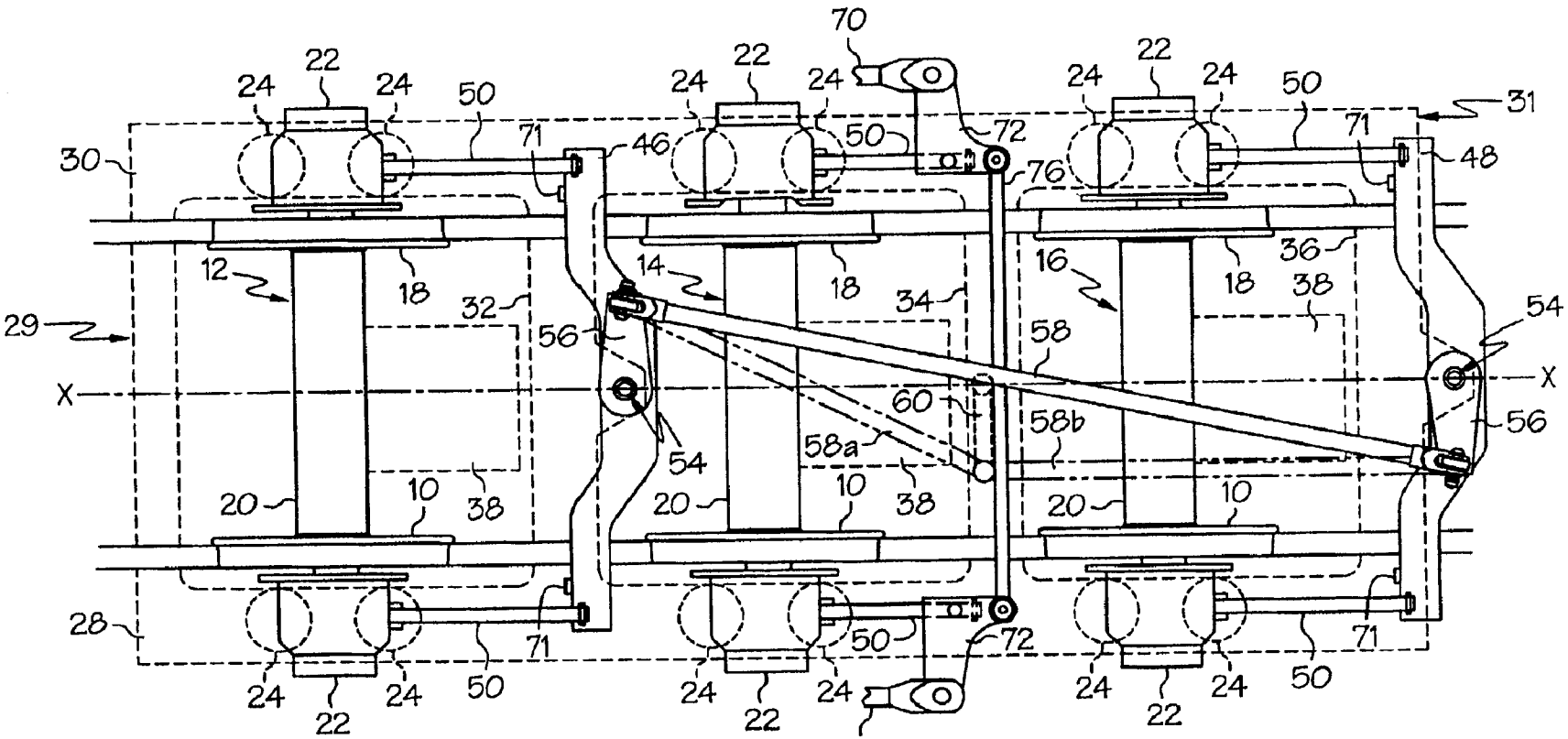
FIG. 2 is a diagrammatic, top-plan view of a running gear for rail vehicles, with some parts being shown in phantom and other parts removed for conveniences of illustration, and three driven wheelsets in the "straight-ahead" position.

The wheelset spring elements 24 allow limited relative motion of the wheelsets 12, 14, and 16 with their bearing housings 22 while resiliently urging the housings and their wheel and axle assemblies into nominally centered non-curving longitudinally aligned positions, as is illustrated in FIG. 2. A wheelset-damping element 26 may also be provided between the bogie 2 and each bearing housing 22 (only two of which are shown) for further suspension.

The bogie 2 may be a unitary or assembled/joined frame, and fabricated, cast, or otherwise manufactured. In particular, the bogie 2 includes a pair of generally parallel, laterally-spaced, longitudinally-extending side frames 28 and 30, which for convenience of illustration are shown in dashed lines in FIG. 2, along with other hereafter-mentioned frame members. The side frames 28 and 30 define a longitudinal axis x, which extends equal distantly therebetween, and have leading and trailing ends 29 and 31. Side frames 28 and 30 are interconnected by longitudinally-spaced, transversely-extending transoms, which in the illustrated embodiment are transoms 32, 34, and 36. A pair of posts 33 and 35 depend from center and trailing transom 34 and 36, respectively, one of each pair is only shown.

For powering the wheelsets to drive the locomotive embodiment, the bogie 2 is then provided with at least two traction motors 38, one driving each axle 20. Each motor is supported by a conventional bearing arrangement on its respective axle, and is carried from one of the adjacent transoms, via a nose link 40 and/or mounting to respective post 33 or 35. Each nose link 40 is flexibly or swively connected at its ends to allow a limited amount of both longitudinal and lateral motion between the traction motor 38 and the adjacent transom by which it is supported.

Those skilled in the art will recognize that the present bogie arrangements may further include additional components and/or arrangements, such as brakes 42, speed recorder 44, other additional suspension members such as, for example, secondary lateral and yaw dampers, lateral and yaw stops, pitching stops and dampers, and components such as, for example, sand boxes and steps, air ducts, and additional transoms. Such components and others are further disclosed by commonly assigned U.S. Pat. Nos. 4,628,824; 4,679,506; 4,765,250; 4,841,873; 5,613,44; and 5,746,135, which disclosures are herein incorporated fully by reference.

To provide for limited self-steering action of the wheelsets while transmitting traction and braking forces between the wheel and axle assemblies and the bogie frame, the bogie 2 is provided with a traction linkage formed in accordance with the invention. This traction linkage includes laterally-extending leading and trailing steering beams 46 and 48, respectively, which are pivotally connected at their centers with the bottoms of adjacent transoms 32 and 36, respectively. The steering beams 46 and 48 allow the rotation of the end wheelsets relative to the bogie frame.

Laterally opposite ends of the leading and trailing steering beams 46 and 48, respectively, are connected with the bearing housings 22 of the leading and trailing wheelsets 12 and 16 by traction links 50. The steering beams 46 and 48 are attached to upstanding torque tubes 52 which extend vertically upward about a pivot axes 54 of the steering beams and connect, at their upper ends, with a respective one of a pair of crank arms 56. These crank arms 56 extend in laterally opposite directions. The ends of the crank arms 56 are interconnected by an inter-axle link 58 which extends diagonally therebetween over the wheelsets 14 and 16 and the transom 34. In one embodiment, the link 58 may be a unitary component, and in another embodiment illustrated in dashed lines, the link 58 may be segmented or of a split design having first and second links 58*a* and 58*b*, which are pivotably supported from the transom 34 by lever arm 60. It is to be appreciated that first and second links 58*a* and 58*b* have the same effective length such that the end axles of the leading and trailing wheelsets rotate the same amount.

To support the leading and trailing steering beams 46 and 48 with their associated torque tubes 52 and crank arms 56, the adjacent transoms 32 and 36 are provided with upper pivot plates 62. At the ends of each pair of posts 33 and 35 provided is a lower pivot plate 64, such that the upper and lower pivot plates carrying through bolts 66. Bolts 66 secure bushings 67 on which the torque tubes 52 are pivotally mounted. It is to be appreciated that the traction links are as long as possible to reduce the angular loading on the bushings 67 from respective wheelsets movement in the vertical and lateral directions relative to the bogie frame. Lower angular loading increases life expectancy, reliability, and reduces the contribution of each traction link 50 to the lateral and vertical stiffness of the bogie frame.

The steering beams 46 and 48, traction links 50, cranks 56, and inter-axle link 58 are so arranged as to require equal and opposite yawing (steering) motions of the leading and trailing wheelsets 12 and 16, respectively, so as to provide efficient inter-related self-steering actions of the end axles. These components comprise a first force transmitting linkage which carry the traction and braking forces between the wheelsets and the bogie frame, as well as allowing equal and opposite self-steering of the end wheelsets 12 and 16.

In another embodiment, a pair of yaw dampers 69 is connected to each steering beam 46 and 48 and the bogie frame, one of each pair only shown by FIG. 1. The yaw dampers 69 are provided for good steering efficiency and high stability by controlling the rotation of the end wheelsets 12 and 16. Since only the relative motion between the steering beam and the bogie frame is rotation around the vertical axis, this damper location ensures that only the steering mode is damped, and reduces the angular loading of the damper bushings. In another embodiment, further control of the end wheelsets 12 and 16 is provided for by steering beam bumpers 71, which limit the rotation of the steering beams of the end wheel sets 12 and 16. The steering beam bumpers 71 may be either mounted to their respective steering beam 46 and 48 or supported on their respective transom 32 and 36.

In another embodiment, the bogie 2 is further provided with a second force transmitting linkage which also pivotably connects the bogie 2 with the carbody 4 to provide for the transfer of traction and braking forces therebetween. The second force transmitting linkage, or carbody linkage, includes a pair of carbody side posts 68 that depends from the carbody 4, only one of which is shown in dashed lines for conveniences of illustration in FIG. 1. Connected to each respective side post 68 is a side rod 70, which is connected to a respective bell crank 72. Each bell crank 72 pivots on a respective carbody linkage support 74 which depends from respective side frames 28 and 30, and only one of which is shown in FIG. 1. Each carbody linkage support 74 also has attached traction links 50 of the center wheelset 14. It is to be appreciated that each traction link 50 attaches between a respective end of the center wheelset 14 and a respective carbody linkage support 74, and does not connect to the bell crank 72 supported by the same support 74. A cross link 76 pivotably interconnects a first end of each bell crank 72. Accordingly, the center wheelset 14 is substantially unpivotably mounted on the bogie 2, but is movable laterally to the longitudinal axis x, which extends through the midsection of the bogie 2. In this arrangement, the carbody linkage allows the transfer of longitudinal loads (due to tractive effort and braking loads) between the bogie 2 and carbody 4, while allowing the bogie to rotate in curves and to move in the lateral direction.

Interconnection of the leading and trailing wheelsets 12 and 16, respectively, through steering beams 46 and 48, by means of the torque tubes 52, crank arms 56, and inter-axle link 58 provides the desired steering interconnection of the end wheelsets, and frees up space between the central and trailing wheelsets axles within space made available by the absent bolster or transverse beam structure typically used to transmit the weight of the vehicle body through a center bearing and springs to the frame of the bogie. The high level of the link 58, positioned over frame transoms 34, allows it to extend over the top of the central traction motor 38. This avoids any need for increasing the overall width of the truck as is done in the linkage arrangement of U.S. Pat. No. 4,679,506.

If the running gear 1 enters a curve, then the leading wheelset 12 is displaced by the geometry of the curve toward the outside of the curve, relative to the center of the running gear located in the cord position. Due to coupling of the leading and trailing wheelsets 12 and 16, via use of the inter-axle link 58, the trailing wheelset 16 is displaced toward the inside of the curve, counter to the leading wheelset 12. This movement is because the inter-axle link 58 is pushed by the pivoting of pivoted crank arm 56 of the leading wheelset 12 about its pivot point 54. At the same time, the aforementioned pivoting motion generates an opposite pivoting motion of the crank arm 56 of the trailing wheelset 16 about its pivot point 54, causing displacement of the trailing wheelset 16 in the longitudinal direction. This displacement acts in opposite directions at the right and the left of the running gear, and thus adjusts the axle of the trailing wheelset 16 to a virtually radial position oriented approximately toward the center of the curve. Additionally, small deviations occur in the location of the center wheelset 14 perpendicular to the longitudinal axis of the running gear.

These various features provide a railroad vehicle and supporting bogie arrangement having self-steering capability, as described in the previously mentioned patents, and with the further benefits of compactness and practicality for multi-axle locomotive trucks, especially those having two or more axles.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A radial bogie for a rail vehicle, comprising:

a frame having longitudinally extending side members laterally spaced by transoms, said side members defining a longitudinal axis and having leading and trailing ends;

leading and trailing wheelsets with axles supported on said frame;

first and second steering beams for pivotally guiding said wheelsets, said first steering beam being pivotably mounted on said frame behind said leading wheelset away from the leading end of the frame, and said second steering beam being pivotably mounted on said frame behind said trailing wheelset adjacent the trailing end of said frame, said steering beams including crank arms coupled thereto;

an inter-axle linkage connected between said crank arms to define a cooperative relationship between said steering beams; and traction links connected between said wheelsets and said steering beams.

2. The radial bogie of claim 1, further comprising a center wheelset with an axle supported on said frame between said leading and trailing wheelsets, said center wheelset being substantially unpivotably mounted on said frame and being movable laterally to said longitudinal axis.

3. The radial bogie of claim 2, wherein said frame further includes side posts, and provided are additional traction links connecting said center wheelset to said side posts.

4. The radial bogie of claim 2, wherein said frame further includes side posts, and provided is a carbody linkage which includes bell cranks pivotably supported on a respective one of said side posts, a cross link pivotably interconnecting first ends of said bell cranks, and side rods connected between a respective one of second ends of said bell cranks and a carbody of the rail vehicle.

5. The radial bogie of claim 1, wherein said inter-axle linkage includes at least two links pivotably supported on said frame by a lever arm.

6. The radial bogie of claim 1, wherein said inter-axle linkage is a single link which extends diagonally above at least one transom.

7. The radial bogie of claim 1, wherein each of said axles is selected from a group of a powered axle, or an unpowered axle.

8. The radial bogie of claim 1, wherein said steering beams further include torque tubes each pivotably mounted on a respective one of said transoms and which extend vertically upward about a pivot axes of a respective one of said steering beams and connect, at their upper ends, with a respective one of said crank arms.

9. A radial bogie for a rail vehicle, comprising:

a frame having longitudinally extending side members laterally spaced by transoms, said side members having side posts and defining a longitudinal axis;

two end wheelsets with axles supported on said frame, said two end wheelsets being pivotably mounted on said frame;

a center wheelset with an axle supported on said frame between said two end wheelsets, said center wheelset being substantially unpivotably connected to said side posts by traction links and being movable laterally to said longitudinal axis;

steering beams for pivotally guiding said end wheelsets, each one of said steering beams being pivotably mounted on said frame behind a respective one of said end wheelsets;

additional traction links connected between said end wheelsets and said steering beams; and an inter-axle linkage connected between said steering beams.

10. The radial bogie of claim 9, wherein said steering beams include crank arms having ends extending in laterally opposite directions, and said inter-axle linkage is connect to said crank arm ends.

11. The radial bogie of claim 9, wherein said inter-axle linkage is a design selected from the group comprising a single link, and at least two links pivotably supported on said frame by a lever arm.

12. The radial bogie of claim 9, wherein said inter-axle linkage extends diagonally above said center wheelset, one of said end wheelsets, and at least one of said transoms.

13. The radial bogie of claim 9, wherein each of said axles is selected from the group of a powered axle, and an un-powered axle.

14. The radial bogie of claim 9, wherein said steering beams further include torque tubes each pivotably mounted on a respective one of said transoms and which extend vertically upward about a pivot axes of a respective one of said steering beams and connect, at their upper ends, with a respective one of said crank arms.

15. The radial bogie of claim 9, further comprising a carbody linkage rotatably connecting said frame to a carbody of the rail vehicle.

16. The radial bogie of claim 15, wherein the carbody linkage includes bell cranks pivotably supported on a respective one of said side posts, a cross link pivotably interconnecting first ends of said bell cranks, and side rods connected between a respective one of second ends of said bell cranks and said carbody of the rail vehicle.

17. A radial bogie for rail vehicles, comprising:

a frame having a leading end and defining a longitudinal axis;

first, second, and third wheelsets having axles being elastically supported on said frame;

a pair of steering beams, one each located behind said first and third wheelsets away from said leading end of said frame;

traction links coupling said first and third wheelsets to said steering beams, and said second wheelset to said frame; and an inter-axle link coupling rotary motions about vertical axes of said steering beams to provide opposite transverse movement of said first and third wheelsets upon traversing curves.

18. A railroad locomotive of the type comprising a carbody supported by at least one self steering radial bogie having a frame having longitudinally extending side members laterally spaced by transoms, said side members defining a longitudinal axis and having leading and trailing ends; leading and trailing driven wheelsets with axles supported on said frame; first and second steering beams for pivotally guiding said wheelsets, said first steering beam being pivotably mounted on said frame behind said leading wheelset away from the leading end of the frame, and said second steering beam being pivotably mounted on said frame behind said trailing wheelset adjacent the trailing end of said frame, wherein said steering beams include crank arms having ends extending in substantially lateral opposite directions; traction links connected between said wheelsets and said steering beams; and an inter-axle linkage connected between said steering beams through said crank arm ends.

19. The railroad locomotive of claim 18, further comprising a center wheelset with an axle supported on said frame between said leading and trailing wheelsets, said center wheelset being substantially unpivotably mounted on said frame and being movable laterally to said longitudinal axis.

20. The railroad locomotive of claim 19, wherein said frame further includes side posts, and provided are additional traction links connecting said center wheelset to said side posts.

21. The railroad locomotive of claim 18, wherein said inter-axle linkage is a design selected from the group comprising a single link, and at least two links pivotably supported on said frame by a lever arm.

22. The railroad locomotive of claim 18, wherein said inter-axle linkage extends diagonally above at least one of said transoms.

23. The railroad locomotive of claim 18, wherein said frame further includes side posts, and provided is a carbody linkage which includes bell cranks pivotably supported on a respective one of said side posts, a cross link pivotably interconnecting first ends of said bell cranks, and side rods connected between a respective one of second ends of said bell cranks and the carbody.

24. The railroad locomotive of claim 18, wherein said steering beams further include torque tubes each pivotably mounted on a respective one of said transoms and which extend vertically upward about a pivot axes of a respective one of said steering beams and connect, at their upper ends, with a respective one of said crank arms.

* * * * *